US005217417A

United States Patent [19]

Zhengang, Li

[11] Patent Number: 5,217,417

[45] Date of Patent: Jun. 8, 1993

[54] DEVICE FOR CONTROLLING THE SWEEPING-ANGLE OF A FAN

[76] Inventor: Zhengang, Li, 15-2 Tai Hua Fang, Dong Feng Zhong Road, Guang Zhou, China

[21] Appl. No.: 751,616

[22] Filed: Aug. 21, 1991

Related U.S. Application Data

[63] Continuation of Ser. No. 312,602, Feb. 21, 1989, abandoned.

[51] Int. Cl.[5] ..... F16H 1/28; F16H 37/12; F03D 5/06

[52] U.S. Cl. ..... 475/175; 475/343; 74/52; 416/79; 416/100

[58] Field of Search ..... 74/42, 52; 475/16, 169-172, 475/175, 178, 218, 329, 343; 416/79, 82, 83, 100, 169 R

[56] References Cited

U.S. PATENT DOCUMENTS

| | | | |
|---|---|---|---|
| 215,527 | 5/1879 | Lozier | 416/79 |
| 526,719 | 10/1894 | Lenoir et al. | 416/79 |
| 585,131 | 6/1897 | Steel | 416/79 |
| 2,253,127 | 8/1941 | Koch | 416/100 |
| 2,597,034 | 5/1952 | Reisch et al. | 74/42 |
| 2,634,905 | 4/1953 | Reisch | 416/100 |
| 2,742,225 | 4/1956 | Gaurdudo | 416/100 |
| 3,945,769 | 3/1976 | Sanderson | 416/79 X |
| 3,977,260 | 8/1976 | Winyard et al. | 74/86 |

*Primary Examiner*—Leslie A. Braun
*Assistant Examiner*—Benjamin Levi
*Attorney, Agent, or Firm*—Bradford E. Kile

[57] ABSTRACT

A device for variable control of the sweeping angle of a fan which includes a worm gear cooperating with a planet gear and a sun gear to provide variable sweep angle with a clutch mechanism to allow for the disengagement of the drive mechanism while varying sweep angle.

14 Claims, 10 Drawing Sheets

DEVICE FOR CONTROLLING THE SWEEPING-ANGLE OF A FAN

This application is a continuation-in-part of application Ser. No. 312,602, filed Feb. 21, 1989 abandoned.

BACKGROUND OF THE INVENTION

This invention relates to a device for controlling the sweeping-angle of a fan and more particularly to a device suitable for controlling the amplitudes of the sweeping-angle when the fan sweeps.

Conventional fans can only work in two modes, either fixed mode (no sweeping) or sweeping mode. That is to say, it can only provide air flow either in a fixed direction or within a sectorial area corresponding to an unvariable sweeping angle. Fixed mode is rarely used even by only one person, because after hitting a person for quite a long time, the wind would make him feel uncomfortable, though it might make him feel cool in a relatively short time. If people are gathering within a relatively small area, the sweeping interval for sweeping mode for a conventional fan would be too long to satisfy them. So it is understandable that people need a fan which is capable of sweeping with adjustable and controllable sweeping angle at their will.

The sweeping device in the conventional electrical fan usually is a four-bar linkage. In order to change the amplitude of the sweeping angle, the length of one of the bars called the crank is changed. Previously, people suggested a scheme to perform such length change, in which a pin or slidable bar can freely move in a slot resulting in corresponding change of the crank length and the parameters of the four-bar linkage, so that the sweeping angle will be adjustable. It should be noticed that the pin or slidable bar is moved and positioned in a slot by the force resulting from a spring on the adjusting mechanism and therefore this will cause some problems. On one hand, it is desired that the elastic force caused by the spring and the friction force between the pin and slot should be as small as possible to make the motion of the pin or slidable bar easy. On the other hand, it is also desired that the above said forces should be large enough to withstand the reaction force caused by connecting bar during the rotation of the crank and therefore to ensure that the pin can be positioned and fixed securely after being adjusted. Unfortunately, it is very difficult to make a compromise especially because of the limited space in the gear box of the sweeping device. So either such a sweeping device based on above scheme will not be easy to adjust or the sweeping angle will shift from a preset value during operation.

SUMMARY OF THE INVENTION

The object of the present invention is to solve the above problem existing in the prior art. The sweeping device of the present invention is not only easy to adjust, but also capable of keeping the crank length constant thereby making the fan always sweep with a predetermined angle.

The achievement of the object is based on a following operation principle in which a planet gear system is used, which comprises a sun gear, a planet gear and a planetary carrier. An eccentric pin is fixed on the planet gear, and the sun gear meshes with said planet gear during operation. The planet gear is pivotally mounted on the planetary carrier which is fixedly connected with a hollow shaft. The sun gear is fixedly connected with a spindle which is coaxially arranged in said hollow shaft. When the planetary carrier rotates with respect to said spindle, the planet gear will rotate about the sun gear. Thus the distance between the axis of the eccentric pin fixed on the planet gear and the axis of the sun gear or the axis of the spindle can be continuously changed, and a length changeable crank is formed between the two axes. The distance between said two axes, i.e. the crank length will be kept constant when the rotation of the planetary carrier is synchronized with that of the sun gear. If said distance between the pin axis and the planet gear axis is equal to the distance between the planet gear axis and the sun gear axis, the crank length will be changeable from zero to maximum value. The maximum crank length will be twice the distance between the planet gear axis and the sun gear axis.

Replacing the constant length crank in the conventional sweeping device of a fan with the length changeable crank of the present invention, the fan can sweep with a sweeping angle adjustable from zero to maximum value.

A main gear is mounted on one of said spindles and said hollow shaft, the main gear is meshed with a worm gear shaft in the conventional sweeping device, by which power is transmitted to sweep the fan and change the crank length.

A clutch is arranged between the hollow shaft and spindle to permit relative rotation of the hollow shaft and spindle while the crank length is adjusted and to permit synchronous movement of the hollow shaft and spindle after the clutch is engaged thereby fixing the desired crank length. The clutch may be of ratchet type, or a friction disk type, or other suitable type. With the clutch being engaged, the spindle and the hollow shaft are locked with each other, thus said planetary gear system becomes a gear system with fixed axes, the sun gear, the planet gear, the planetary carrier. and the eccentric pin all rotating about the axis of the sun gear, and the crank rotating with a fixed length previously set. With the clutch being disengaged, the spindle and the hollow shaft are disconnected, and the rotation of another one of the said spindle and said hollow shaft which is not connected with said main gear is stopped. Thus the gear system with fixed axes again becomes a planetary gear system, resulting in the rotation of the planet gear with respect to the sun gear. Thus the distance between the axes of the sun gear and the axis of the eccentric pin fixed on the planet gear is changed, so is the crank length.

The engaging and disengaging of the clutch is performed by an adjusting mechanism. The adjusting mechanism according to the present invention may be of manually operated type or automatically operated type.

The principle of the manual adjusting mechanism is as follows: the clutch is first manually disengaged by the user and the crank length is changed. Then the length change is fed back by some electric or mechanical means and shown on some kind of indicator. When the crank length corresponding to a sweeping angle is shown as desired, the clutch is then manually engaged and the fan will sweep within the adjusted angle.

The principle of operation of the automatic adjusting mechanism is as follows: an instruction for adjusting to a desired sweeping angle is inputted to the adjusting mechanism: The automatic adjusting mechanism then will automatically disengage the clutch and adjust the crank length. When the adjusted crank length corresponds to the desired sweeping angle, the clutch will automatically be engaged by the adjusting mechanism. Thus the fan will sweep within the desired sweeping angle.

In one type of the automatic adjusting mechanism according to the present invention, a sun gear and a planetary carrier are respectively fixed at the lower end of the spindle and the hollow shaft; a main gear meshed with a worm gear shaft is fixed at the upper end of the hollow shaft, a closed cam surface is integrated on the main gear, and a carrier is securely mounted on the upper end of the spindle. The clutch is of a ratchet-pawl type, the ratchet is the above said main gear and the pawl mounted on the carrier is biased into engagement by a spring means; a supporter, which can rotate in a horizontal plane about a vertical pin, is mounted on the carrier. The supporter comprises a pushing plate and a swinging bar which can rotate about a horizontal pin on the supporter in a vertical plane and is biased downwardly by a spring means. A baffle is mounted on the casing of the device. The baffle is capable of moving only in one direction, for example, reciprocating in the vertical direction. On the lateral of the baffle there is a notch through which only the free end of the swinging bar rotate with the carrier. The front end of said pushing plate is abutted upon the pawl. The pushing plate is integrated with a stopper cooperated with a stopping surface formed on the carrier to delimit the motion of the supporter. A follower reciprocally movable is also mounted on the carrier. One end of the follower is alerted against the swinging bar and another end can slide along the said cam surface. In this structure, the rising and falling of the cam surface causes the follower to reciprocate in approximately vertical direction. It is understandable that the cam surface may also undulate laterally so that the follower reciprocates in approximately horizontal direction. In latter arrangement, the swinging bar can be saved and the follower moved horizontally can directly cooperate with the notch of the baffle which moves reciprocally in approximately the horizontal direction.

Because a planetary gear system is used to adjust the crank length in the device according to the present invention, the crank length can be varied from zero to maximum value at will. That is to say, the fan with the controlling device of the present invention can sweep with any sweeping angle ranging from zero to maximum value as desired.

Moreover, because a clutch is used in the device, adjusting the crank length is very easy and convenient. When adjusting, you only need to change the position of the baffle or press a key for controlling the engagement or disengagement of the clutch. The power for adjusting the crank length is provided by the fan motor, and the crank length after adjusting is fixed by the engaged clutch so that it will remain unchanged. The device according to the present invention therefore has the advantages of being easily and conveniently adjusted and being smooth and reliable in running.

Other advantages and alternatives of the present invention will appear more clearly from the following detailed description which will be followed by preferred embodiments.

DESCRIPTION OF THE PREFERRED EMBODIMENT

Figure 1:
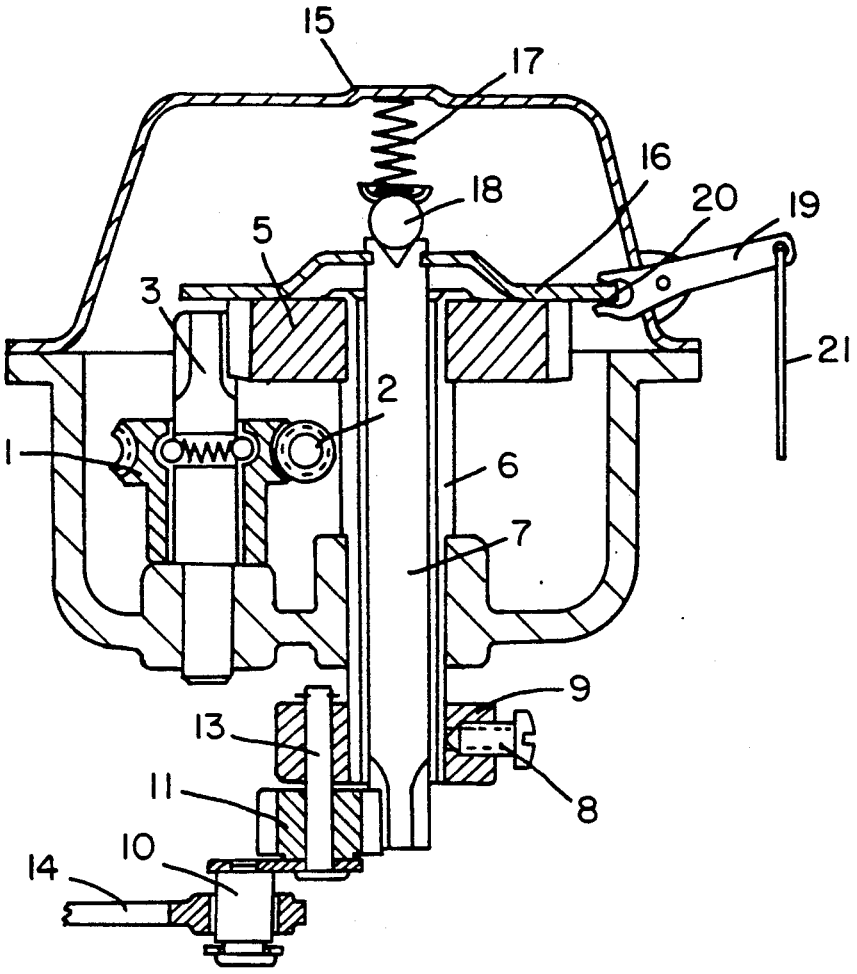
FIG. 1 is a sectional view of the first embodiment of a device for controlling the sweeping angle of a fan according to the present invention, wherein the clutch is of a frictional type.
Figure 2:
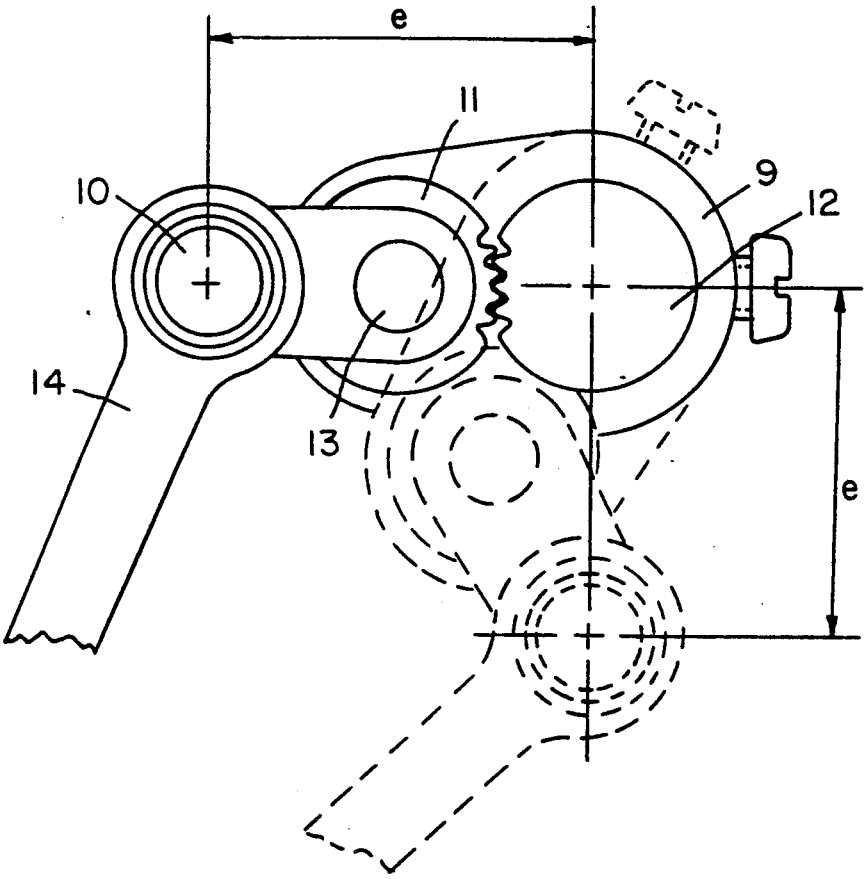
FIG. 2 is a partial bottom view of the device shown in FIG. 1, showing the construction of the planetary gear system.

Referring to FIGS. 1 and 2, a worm gear 1 is meshed with a worm 2 connected with a motor shaft. Motion can be transmitted to a main gear 5 by a worm gear shaft 3. A well known unloading means and a clutch (not shown) are arranged between the worm gear 1 and its shaft 3. When the loading of the worm gear is increased up to a certain value, the unloading means will automatically cause the connection between the worm gear 1 and the worm gear shaft 3 to release, the clutch means causes the fan to stay in a fixed direction. For simplicity, the teeth meshed with the main gear 5 are located on the upper end of the worm gear shaft 3, by which the power can be transmitted to the main gear 5. The main gear 5 is mounted on the upper end of a hollow shaft 6 (or a spindle 7), the spindle 7 being rotatable with respect to the hollow shaft 6 is coaxially arranged in the hollow shaft 6. The lower end of the hollow shaft 6 is securely connected with a planetary carrier 9 by an screw 8. A planet gear 11 with a eccentric pin 10 is pivoted on the planetary carrier 9 by a pin 13. A sun gear 12 is fixed on the spindle. The planet gear 11 can rotate about the pin 13 and is meshed with the sun gear 12. Thus a planetary gear system is formed by the sun gear 12, the planet gear 11 and the planetary carrier 9. The spindle 7 may rotate with respect to the hollow shaft 6 which is connected with the planetary carrier 9. The planet gear 11 is eccentrically equipped with a crank pin 10 which may be integrated with the planet gear 11. Pivoted with the pin 10 is one end of a connecting bar 14. When the planetary carrier 9 rotates with respect to the spindle 7, the planet gear 11 will rotate with respect to the sun gear 12 and this will continuously change the distance between the axis of the crank pin 10 and the axis of the spindle 7, forming a length changeable crank. Usually the distance between the axes of the crank pin 10 and the planet gear 11 is selected to be equal to the centre-to-centre distance between the sun gear 12 and the planet gear 11. In this case, the crank length can be varied from zero to a maximum value which is twice the centre-to-centre distance between the sun gear 12 and the planet gear 11. By replacing the constant length crank in the four bar linkage of a conventional fan with the length changeable crank, the sweeping angle of the improved fan may be varied from zero to a maximum value, for instance 120°. Power is transmitted from the fan motor (not shown) to the main gear 5 through the worm 2, the worm gear 1 and the worm gear shaft 3. The four bar linkage will then swing accordingly, and the fan will sweep with the swinging of one of the said four bars.

In order to perform the crank length adjusting, a clutch means is arranged between the hollow shaft 6 and the spindle 7. The clutch means may be of a ratchet type or a friction type or other suitable type. The 'engaging' and 'disengaging' positions of the clutch can be controlled either manually or automatically. The clutch means used in the first embodiment is of a manually operated friction type, wherein a friction disk 16 is biased to abut on the upper end surface of the main gear 5 by a spring 17 via a steel ball 18, as shown in FIG. 1. One end of the spring 17 is abutted to a cover 15. An operating lever 19 is used to raise the friction disk 16 so as to separate it from the main gear 5, a clamping slot 20 is formed on the free end of the lever 19 for braking the friction disk 16 after separating. The action of the lever 19 is controlled via a pulling cable 21 by a key (not shown) mounted on the controlling board of a fan.

When the key is released, the friction disk 16 is connected with the main gear 5, integrating the hollow shaft 6, the spindle 7, the planetary carrier 9, the planet gear 11, the sun gear 12 and the crank pin 10, thus obtaining a gear system with fixed axes which operates with a constant crank length which determines the fan's sweeping angle. The solid line in FIG. 2 shows the position of the system with a maximum crank length. If the sweeping angle is to be changed to the position as shown by dotted lines in FIG. 2, the key is pressed to cause the friction disk 16 to separate from the main gear 5 by the lever 19. The clamping slot 20 then brakes the friction disk 16. Because the planetary carrier 9 is still driven by the motor, the planet gear 11 and the crank pin 10 will be forced to rotate about the pin 13 so that the crank length will be changed. When the length is changed to a suitable value, the key is released to bring the friction clutch into engagement. Thus the fan will sweep with a new sweeping angle which is determined by the changed crank length.

Figure 3:
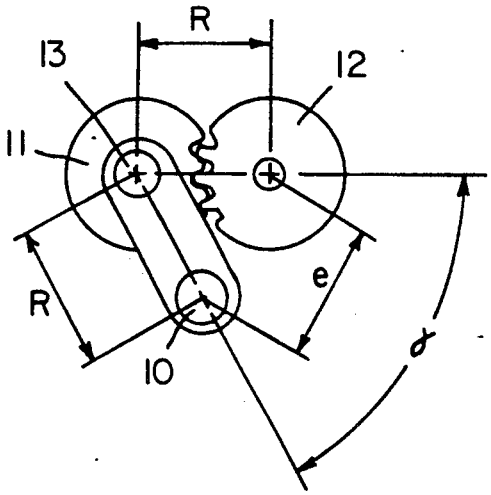
FIG. 3 is a diagram of the planetary gear system, showing the relationship of the parts in the system.

FIG. 3 shows the geometric relationship between crank length, the hollow shaft and spindle, etc. it may be known from FIG. 3 that:

$$e^2 = R^2 + R^2 - 2R\,R\,\mathrm{COS}\alpha,$$

$$e = \sqrt{2R^2(1 - \mathrm{COS}\alpha)}\ , \text{ where } \alpha = n\beta$$

so $$e = \sqrt{2} \cdot R \cdot \sqrt{1 - \mathrm{COS}n\beta}\ ,$$

where R stands for the centre-to-centre distance of the planet gear and the sun gear, e is the crank length, $\alpha$ is the phase angle difference between the planet gear and the sun gear, $\beta$ means the phase angle difference between the spindle and the hollow shaft, n is the ratio of the sun gear tooth number to the planet gear tooth number. (n=1, 2, 3, 4, . . . )

Figure 4:
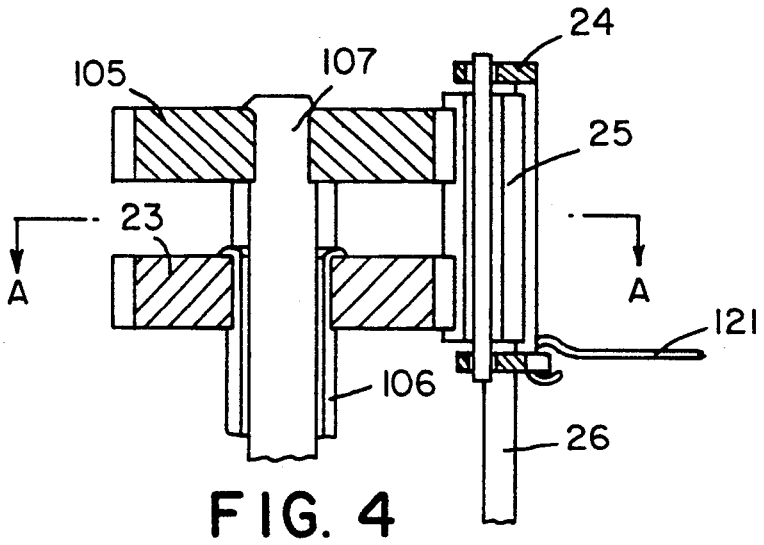
FIG. 4 is a sectional view of the second embodiment of the device for controlling the sweeping angle of a fan according the present invention, showing the construction of a ratchet type clutch, the planetary gear system (not shown) being the same as that in the first embodiment.

The second embodiment of the device for controlling the sweeping angle of the fan according to the present invention is shown in FIG. 4, wherein the adjusting mechanism contains a ratchet type clutch which is manually operated. The construction and the operation of the planetary gear system are the same as that in the first embodiment and therefore description is omitted here.

Figure 5:
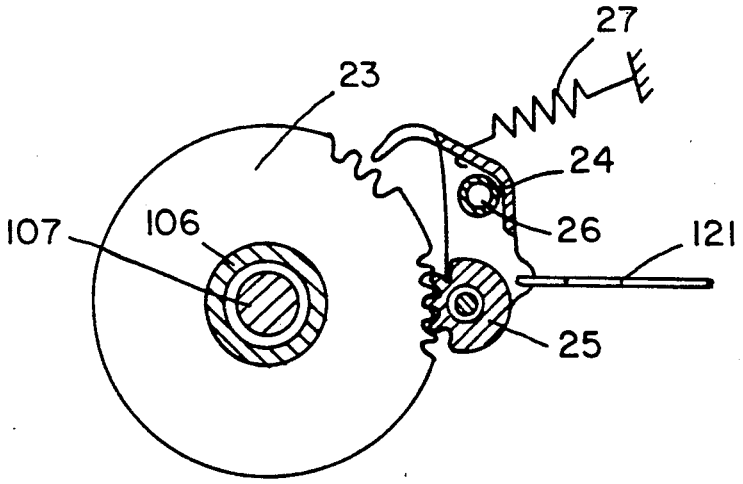
FIG. 5 is a sectional view along A—A of the device shown in FIG. 4, wherein the ratchet clutch is in the 'engaging' position.
Figure 6:
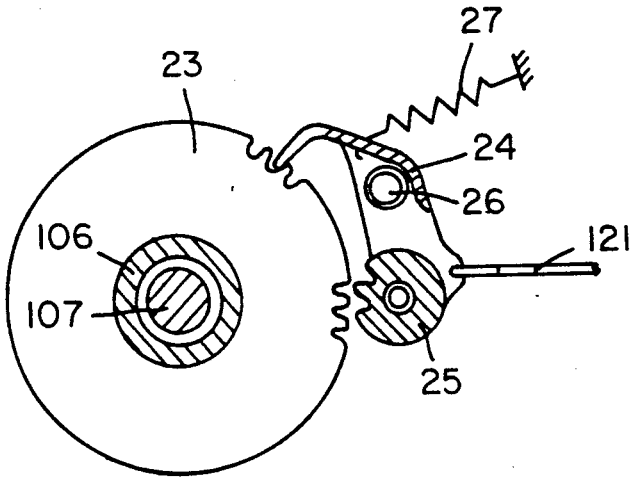
FIG. 6 is a drawing similar to FIG. 5, wherein the ratchet clutch is in the 'disengaging' position.
Figure 7:
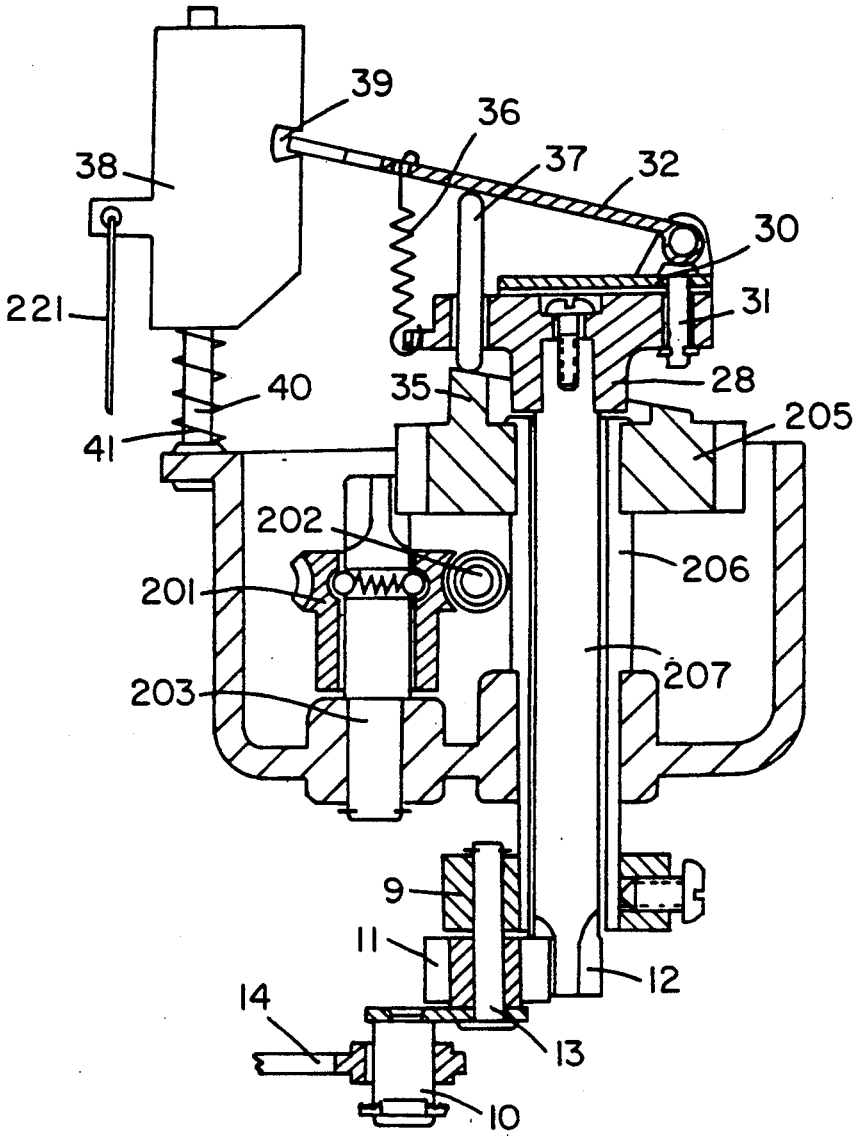
FIG. 7 is a sectional view of the third embodiment of the present invention, showing the construction of the device with an automatic adjusting mechanism.
Figure 8:
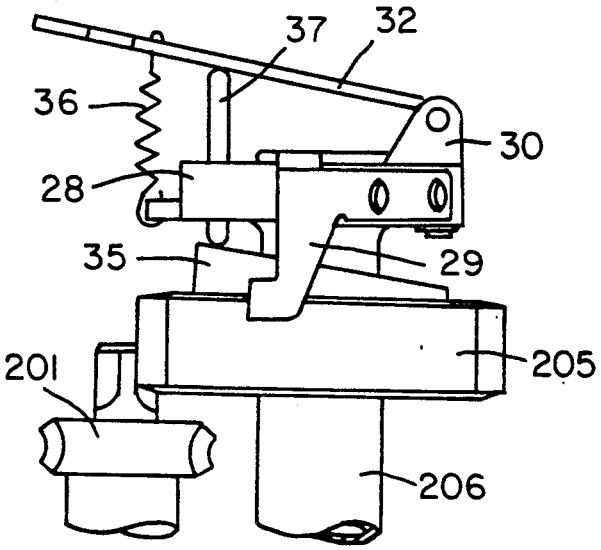
FIG. 8 is a partial front view of the automatic adjusting mechanism shown in FIG. 7.
Figure 9:
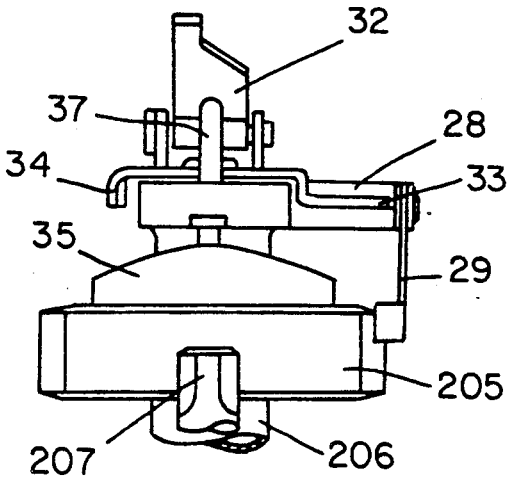
FIG. 9 is a partial view of the automatic adjusting mechanism shown in FIG. 7.

With reference to FIG. 4, a driven gear 23 is provided, which has the same teeth number and modulus as the main gear 105. Said gear 23 is mounted on the hollow shaft 106 and the gear 105 is mounted on the spindle 107. A clutch means comprises a pinion 25 and an escapement lever which may pivot about a pin 26. Said pinion 25 is rotatably mounted on the escapement lever 24 which has a tip at one end thereof. Normally, the spring force caused by a spring 27 will make the pinion 25 mesh with both gear 105 and gear 23 and that is the 'engaging' position of the clutch means as shown in FIG. 5. Motor power can be directly transmitted either to the gear 105 or the gear 23. In this embodiment, the motor power is transmitted to the gear 105 (not shown). When the sweeping angle is adjusted, a cable 121 is pulled to make the escapement lever 24 pivot so that the pinion 25 will be disengaged with both gears 105 and 23 and at the same time the tip of the escapement lever 24 will be inserted into the teeth of the gear 23 (or gear 105, if power is directly transmitted to the gear 23), to stop the rotation thereof, as shown in FIG. 6.

FIGS. 7 to 11 show another embodiment of the present invention, wherein the sweeping angle in this embodiment is automatically adjusted. By inputting a desired sweeping angle signal, the adjusting mechanism of the device will automatically control the engaging and disengaging positions of the clutch means and find the corresponding crank length. The planetary gear system in this embodiment is the same as the above mentioned embodiment; therefore, the description is omitted here.

Figure 10:
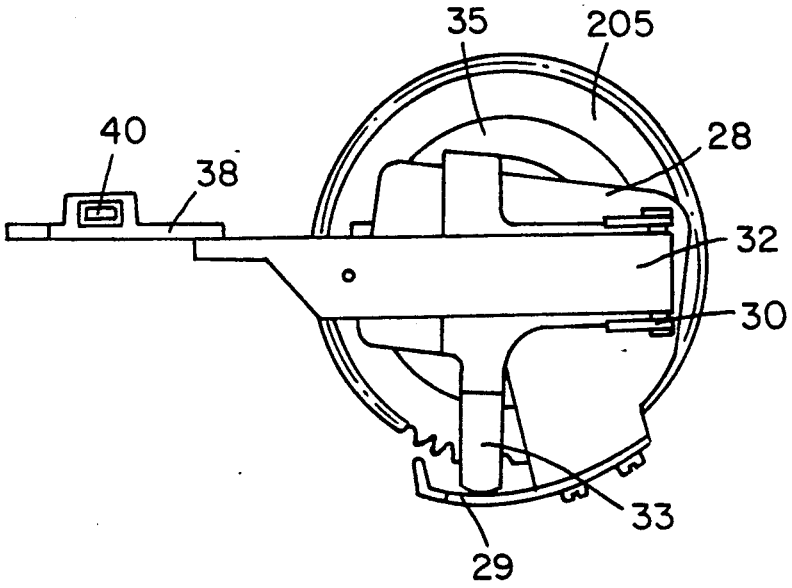
FIG. 10 is a partial top view of the automatic adjusting mechanism shown in FIG. 7, wherein the clutch is in 'disengaging' position.
Figure 11:
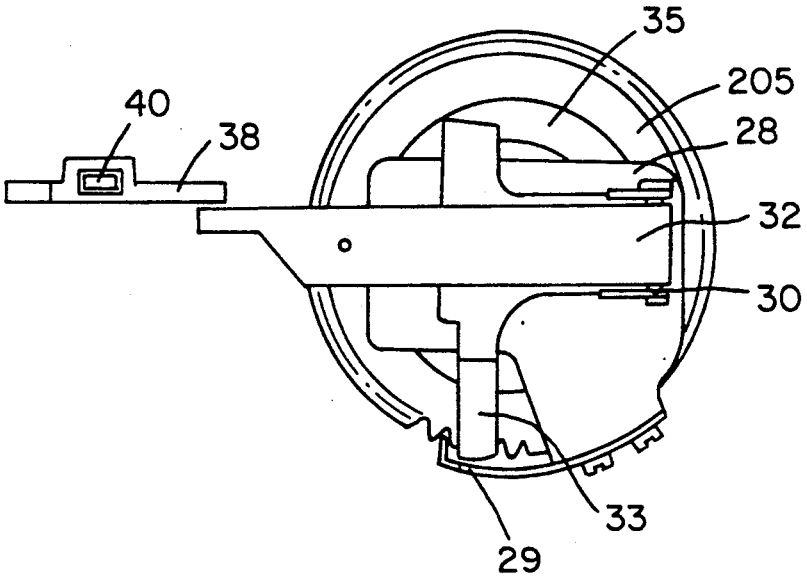
FIG. 11 is a drawing similar to FIG. 10, wherein the clutch is in 'engaging' position.

With reference to FIGS. 7 to 11, a worm 202 connected with a motor is meshed with a worm gear 201. Motion is transmitted by the worm gear shaft 203 to a main gear 205. The well known unloading means and a clutch (not shown) are arranged between the worm gear 201 and its shaft 203. When the loading of the worm gear 201 is increased to a certain value, the unloading means will automatically cause the connection between the worm gear 201 and the shaft 203 to release. Said clutch is used to control the fan to stay at an orientation position. For simplicity, the teeth meshed with the main gear 205 are directly formed on the upper end of the worm gear shaft 203, which is rotatably mounted on a casing of the device. The main gear 205 may be fixed on either a hollow shaft 206 or on a spindle 207, i.e. power is introduced either to the hollow shaft 206 or to the spindle 207. In this embodiment, the motor power is introduced to the hollow shaft 206 and a carrier 28 is therefore mounted on the spindle 207. In this arrangement it is easier to construct the introduction of the motor power. If the main gear 205 is mounted on the spindle 207, the carrier 28 should be correspondingly mounted on the hollow shaft 206. A pawl 29 used as a clutch part is mounted on the lateral of the carrier 28. Said pawl 29 is biased into engagement with the main gear 205 by a spring means during normal operation, so that the hollow shaft 206 will rotate with the spindle 207 which is coaxially arranged in the hollow shaft 206. FIG. 10 shows the main gear disengaged with the pawl 29 and FIG. 11 shows the main gear 205 engaged with the pawl 29. A supporter 30 mounted on the carrier 28 is sweepable on the supporting surface about a pivot 31. Said supporter 30 comprises a swinging bar 32, a pushing plate 33, a stopper 34, the pushing plate 33 and the stopper 34 are integrally formed. When the supporter 30 is sweeping, it will push the pawl 29 out of the engagement with the main gear 205. The stopper 34 extends approximately vertically and is cooperated with a lateral surface of the carrier 28 with such a suitable distance between the stopper 34 and the carrier 28 that the stopper 34 may just abut the lateral surface of the carrier 28 when the pawl is pushed off the teeth of the main gear 205 by the pushing plate 33 so as to stop the rotation of the supporter 30. The upper end of the main gear 205 is formed with a closed cam surface 35. The cam surface facing upward may be smoothly curved. The supporter 30 is equipped with a swinging bar 32 which can sweep together with the supporter 30 with respect to the carrier 28, one end of the swinging bar 32 is pivotably mounted on the supporter 30. A pulling spring 36 is used to pull the swinging bar 32 which consequently pushes a cam follower 37 downwardly, so that one end of the cam follower 37 can always be kept in contact with the cam surface 35 of the main gear 205. The cam follower 37 is slidably positioned in a guide hole of the carrier 28 and its two ends are in contact with the swinging bar 32 and the cam surface 35 of the main gear 205, respectively. The two ends of the cam follower 37 may be manufactured as ball-shaped or equipped with roller(s) to improve their moving abilities. When the spindle 207 rotates with respect to the hollow shaft 206, the swinging bar 32 will swing upwardly and downwardly with the curve of the cam surface 35 under the action of the cam follower 37 and the pulling spring 36. The swinging bar 32 has two functions: the first is to swing in accordance with the locus determined by the curve of the cam surface 35, so that the relative angular displacement between the spindle 207 and the hollow shaft 206 can be diminished. The second is to produce a torque when the rotation of the swinging bar 32 is resisted, causing the clutch to disengage and the spindle to stop rotating. In order to control the relative angular displacement between the spindle 207 and the hollow shaft 206, an adjustable baffle 38 is arranged on the casing and is mounted on a guide post 40 of the casing. The baffle can not rotate and may be controlled by a knob on the control board of a fan via various transmission means, for instance, a pulling cable 221, to move along a line substantially parallel to the axis of the cam follower 37. A notch 39 with proper shape such as a wedge shape is formed at the suitable position on the lateral of the baffle 38. The opening of the notch only allows the free end of the swinging bar 32 to pass through, that is to say the opening of the notch should be only a little bit larger than the thickness of the swinging bar 32.

Each sweeping angle of the fan corresponds to a crank length, and the relationship there between may approximately be considered as a linear function. The relation of the crank length to the relative angular displacement is $$e = \sqrt{2R^2 (1 - \cos n\beta)} \ .$$

In order to get an approximately linear function between the fan sweeping angle change and the displacement of the baffle 38, the cam surface 35 should be formed with a nonlinear curve.

A closed-loop isochronous control system has been established in this embodiment, the operation is as follows:

The main gear 205 is driven by the motor via the worm 202, the worm gear 201, the worm gear shaft 203. The position of the notch 39 is set by a certain displacement of the baffle 38 which is controlled by the knob on the control board of a fan. A given signal is thus input to the control system. The value of the crank length, the adjusted object, is sampled by the cam-swinging bar mechanism and is amplified by the swinging bar 32. The amplified value of the crank length is fed back to the baffle 38 via the free end position of the swinging bar 32. The baffle 38 itself is also a comparator which is capable of calculating the difference between the sampled value and the given value. When the sampled value is equal to the given value, the position of the swinging bar 32 will be so matched with the position of the notch 39 that every cycle of the swinging bar 32 will not be resisted by the notch 39. If the sampled value is different from the given value, the free end of the swinging bar 32 will be stopped by the baffle 38 when it rotates to the baffle's position. This will disengage the clutch. As a result, the planetary gear system will responds by changing the crank length and the fan sweeping angle as well. At the same time, the cam surface will drive the swinging bar 32 to swing and the free end of the swinging bar 32 will slide on the lateral edge of the baffle 38, giving a new sample of the crank length to the baffle 38 to compare with the given value. Because of the continuity of the curved cam surface, the above device will finally find a sampled value which is in accordance with the given value both if the given value is increased or decreased. When this is done, the free end of the swinging bar 32 will find and pass the notch 39. Therefore the stopped spindle 207 will be released and the clutch will be engaged so that the crank length adjusting process is finished and the fan will operate with a new sweeping angle.

The preferred embodiment of this invention has been described. It should be understood that this invention will not be limited to those embodiments and that other improvements and changes could be made within the claimed scope of the present invention. For instance, the smoothly curved cam surface may be formed on the lateral of the cam. In this case, the cam follower 37 and the swinging bar 32 can be integrally formed and arranged horizontally. The baffle 38 is also arranged horizontally and with the notch 39 facing downwardly. One end of the cam follower, which does not contact with the cam surface, is bent upwardly. This bent part of the cam follower performs the same functions as the free end of the swinging bar 32 in the above embodiment. The cam follower is mounted in a sleeve formed on the supporter 30, allowing the motion of the cam follower along the axis of the sleeve. When the free end of the cam follower (like the swinging bar 32) is stopped by the baffle, the supporter 30 will sweep with respect to the carrier so that the pawl will be pushed away from the main gear 205.

It should also be noted that in the pawl-ratchet type clutch means used in the device of the present invention wherein the ratchet functions as the main gear, the engaging position of the pawl with the ratchet and the meshing position of the main gear with the worm gear shaft are offset in the thickness direction of the main gear (ratchet).

What is claimed is:

1. A device for controlling the sweeping angle of a fan comprising:

a casing;

a worm gear having a shaft;

a main gear meshing with said worm gear shaft;

a spindle;

a hollow shaft;

said main gear mounted on one end of said spindle and said hollow shaft;

a planetary carrier fixedly mounted on a lower end of said hollow shaft carrying a planet gear rotatable about a central axis of said hollow shaft;

a crank pin fixed on said planet gear;

a connecting bar having one end articulated with said crank pin;

a sun gear integrated with one end of said spindle and meshing with said planet gear;

a clutch means disposed between said spindle and said hollow shaft; and an adjusting means for controlling said clutch means.

2. A device as claimed in claim 1, wherein said clutch means comprises a pawl and a ratchet.

3. A device as claimed in claim 2, wherein said main gear functions as said ratchet.

4. A device as claimed in claim 3, wherein said adjusting means comprises a second carrier fixedly mounted on the upper end of said spindle; a supporter placed on said second carrier and swingable about a vertical pin, said supporter swingable substantially in a horizontal plane, said supporter further comprising a pushing plate and a swinging bar, said swinging bar being mounted on said supporter about a substantially horizontal pin and swingable substantially in a vertical plane and biased by a spring means; a baffle mounted on said casing and controllably movable reciprocally only in a vertical direction, said baffle having a lateral edge with a notch formed thereon, one end of said swinging bar adapted to pass said baffle through said notch, said swinging bar mounted onto said second carrier so as to rotate together with said second carrier; said pawl being mounted on said second carrier with said pushing plate abutted thereon; a closed cam surface formed on said main gear; and an elongated cam follower slidably mounted on said second carrier with one end of said cam follower slidably abutting on said cam surface and another end abutting on said swinging bar.

5. A device as claimed in claim 4, wherein said supporter further comprises a stopper means integrally formed with said pushing plate, said stopper means extending substantially vertically and cooperating with a stopping surface formed on said second carrier to delimit the motion of said supporter.

6. A device as claimed in claim 2, wherein said pawl is biased into engagement with said ratchet by a spring means.

7. A device as claimed in claim 4, wherein said notch formed on said baffle is wedge shaped, the width of the opening of the notch being slightly larger than the thickness of the said one end of said swinging bar.

8. A device as claimed in claim 5, wherein the distance between said stopper means and said stopping surface is large enough to enable said pushing plate to push said pawl out of engagement with said ratchet.

9. A device as claimed in claim 3, wherein the engaging position of said pawl with said ratchet and the meshing position of said main gear with said worm gear shaft are offset in the axial thickness direction of said main gear.

10. A device as claimed in claim 1, wherein the distance between the axes of said sun gear and said planet gear is equal to the distance between the axes of said planet gear and said crank pin.

11. A device as claimed in claim 1, wherein said crank pin is integrally formed with said planet gear.

12. A device as claimed in claim 1, wherein said clutch means comprises a friction disk fixedly mounted on another one of said spindle and said hollow shaft, said spindle being axially movable with respect to said hollow shaft, said friction disk being biased into frictional engagement with said main gear by a spring means, said adjusting means comprises a lever being controlled to move said friction disk out of engagement with said main gear and simultaneously brake said friction disk.

13. A device as claimed in claim 12, wherein the end of said lever cooperated with said friction disk being provided with a clamping slot.

14. A device as claimed in claim 1, wherein said clutch means comprises a driven gear fixedly mounted on another one of said spindle and said hollow shaft, said driven gear being identical to said main gear; an escapement lever pivotably mounted on said casing having a pinion rotatably disposed thereon and a tip; said escapement lever being biased by a spring means to make said pinion come into mesh with said driven gear and said main gear, a cable being connected with said escapement lever to control said pinion out of mesh with said driven gear and said gear and simultaneously brake said driven gear by inserting said tip of said escapement lever into the teeth of said driven gear.

* * * * *